US005660153A

United States Patent [19]

Hampton et al.

[11] Patent Number: 5,660,153

[45] Date of Patent: Aug. 26, 1997

[54] VALVE CONTROL SYSTEM

[75] Inventors: Keith Hampton, Ann Arbor; David M. Preston, Clarkston; Dale A. Stretch, Novi; Douglas J. Nielsen, Marshall; Neal L. Tack, Delton, all of Mich.

[73] Assignee: Eaton Corporation, Cleveland, Ohio

[21] Appl. No.: 412,474

[22] Filed: Mar. 28, 1995

[51] Int. Cl.[6] ..... F01L 13/00; F02D 13/06

[52] U.S. Cl. ..... 123/90.16; 123/90.41; 123/90.46; 123/198 F

[58] Field of Search ..... 123/90.15, 90.16, 123/90.17, 90.27, 90.32, 90.39, 90.41, 90.42, 90.43, 90.44, 90.46, 198 F; 74/519, 559

[56] References Cited

U.S. PATENT DOCUMENTS

| | | | |
|---|---|---|---|
| 4,151,817 | 5/1979 | Mueller | 123/90.16 |
| 4,203,397 | 5/1980 | Soeters, Jr. | 123/90.16 |
| 4,556,025 | 12/1985 | Morita | 123/198 F |
| 4,607,600 | 8/1986 | Yoshizaki | 123/90.16 |
| 4,726,332 | 2/1988 | Nishimura et al. | 123/90.16 |
| 4,844,023 | 7/1989 | Konno et al. | 123/90.16 |
| 5,239,952 | 8/1993 | Morita | 123/90.16 |
| 5,297,516 | 3/1994 | Hara | 123/90.16 |
| 5,415,137 | 5/1995 | Paul | 123/90.16 |
| 5,544,626 | 8/1996 | Diggs et al. | 123/90.16 |

FOREIGN PATENT DOCUMENTS

| | | |
|---|---|---|
| 4136143 | 5/1993 | Germany . |
| 2185784 | 6/1987 | United Kingdom . |

*Primary Examiner*—Weilun Lo
*Attorney, Agent, or Firm*—L. J. Kasper

[57] ABSTRACT

A valve control system for an internal combustion engine, which is particularly adapted for selectively actuating and deactuating an engine valve. The system includes an inner rocker arm which contacts the cam and an outer rocker arm which engages the valve, the inner and outer arms being in nesting relation to one another and in pivotal contact with the output plunger of a stationary lash adjuster. A sliding latch member is movable between an active position wherein the inner and outer arms are effectively latched together to transmit the force of the cam through the inner and outer arms to the valve, and an inactive position wherein the inner and outer arms are free to move relative to one another. A spring acting between the inner and outer arms biases the inner arm into engagement with the cam and the outer arm, and the outer arm into engagement with the valve and the lash adjuster. Positive stops between the inner and outer arms are effective to limit lash adjuster leak down.

9 Claims, 3 Drawing Sheets

VALVE CONTROL SYSTEM

The present invention relates to valve operating apparatus for an internal combustion engine and, more particularly, to apparatus to vary the operational characteristics of intake or exhaust valves in such engines during various operational modes of the engine.

Variable vale control systems for multiple valve engines wherein the intake and/or exhaust valves can either be selectively actuated or actuated at selected lift profiles, are well known in the art.

One known system is shown in U.S. Pat. No. 4,151,817, which discloses a primary rocker arm element engageable with a first cam profile, a secondary rocker arm element engageable with a second cam profile, and means to interconnect or latch the primary and secondary rocker arm elements.

It is an object of the present invention to incorporate the latchable rocker arm concept of the above system in a system which is specifically operable to selectively actuate or deactuate an engine valve. It is a further object to provide such a system which is less expensive to manufacture, has improved response, requires less operating force and has a longer useful life than prior art systems.

A particular problem exists in prior art systems which operate in a valve train which incorporates hydraulic lash adjusters in that means must be provided to prevent the lash adjuster from overly expanding or "pumping up" when the valve is in its inactive mode and there is essentially no resisting force applied by the valve spring. In prior art systems it has been necessary to provide an auxiliary contact surface on the rocker arm structure which is maintained in engagement with a base circle cam portion formed on the camshaft.

The present invention meets the above objectives and solves the above problems by providing a latchable rocker arm assembly including an inner rocker arm having a roller which contacts the cam; an outer rocker arm which engages the valve, the inner and outer arms being in nesting relation to one another and in pivotal contact with the output plunger of a stationary lash adjuster; and a sliding latch member which is moveable between an active position wherein the inner an outer arms are effectively latched together and operable to actuate the valve, and an inactive position wherein the inner and outer arms are free to move relative to one another and the valve is not actuated. The assembly further includes biasing means acting between the inner and outer arms to bias the inner arm into engagement with the cam and with the outer arm and the outer arm into engagement with the plunger of the lash adjuster. In the unlatched mode the biasing means prevents lash adjuster pump up by loading the outer arm against the plunger. A positive stop is provided to limit lash adjuster leak down caused by the load of the biasing means against the lash adjuster plunger in the unlatched mode.

Other objects and advantages of the invention will be apparent from the following description when considered in connection with the accompanying drawings, wherein.

Figure 2:
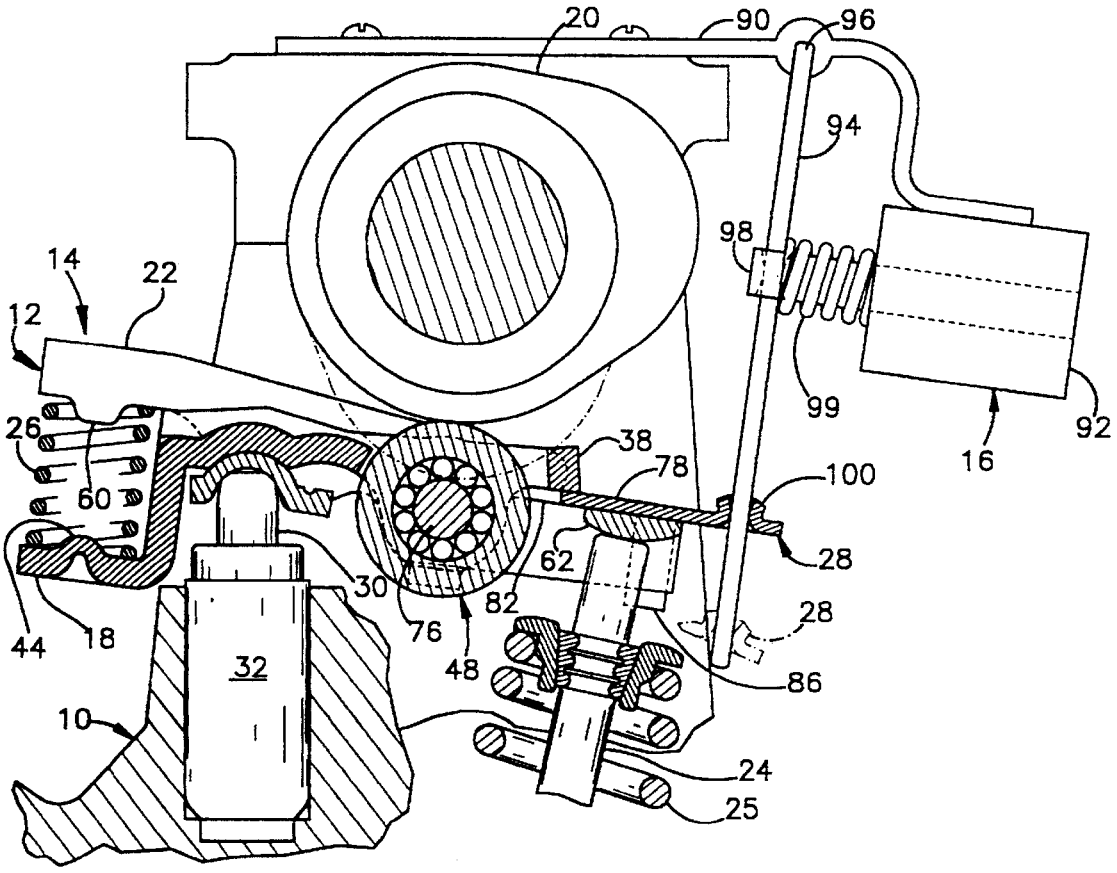
FIG. 2 is a sectional view taken along line 2—2 of FIG. 1.

Referring primarily to FIG. 2, there is illustrated a portion of the cylinder head 10 of an internal combustion engine of the overhead cam type which incorporates the valve control system 12, of the invention. As illustrated herein, the control system 12 is of the type which is particularly adapted to selectively actuate or deactuate an engine valve and comprises a rocker arm assembly 14 which is shiftable between an active mode wherein it is operable to open the valve, and an inactive mode wherein the valve is not opened; and an actuator assembly 16 which is operable to shift the rocker arm assembly between its active and inactive modes.

The rocker arm assembly 14 comprises an inner arm assembly 18 which is engageable with the valve actuating cam 20 of the engine, an outer arm 22 which is engageable with a poppet valve 24 which is maintained normally closed by a spring 25, a biasing spring 26 which acts between the inner and outer arms to bias the inner arm into engagement with the cam 20 and the outer arm into engagement with the plunger 30 of a stationary lash adjuster 32, and a latch member 28 which is slidably received on the outer arm and which is effective to latch the inner and outer arms together to define the active mode of the control system or to unlatch them to define the inactive mode. In the preferred embodiment of the invention the outer arm 22 is pivotally mounted on the plunger 30 and the inner arm 18 is pivotally mounted on outer arm 22. The construction and the function of the lash adjuster 32 are well known and will not be described in detail herein.

To provide a better understanding of the relationship between the inner and outer rocker arms, reference is made to the details of these components in FIGS. 3–6.

Figure 3:
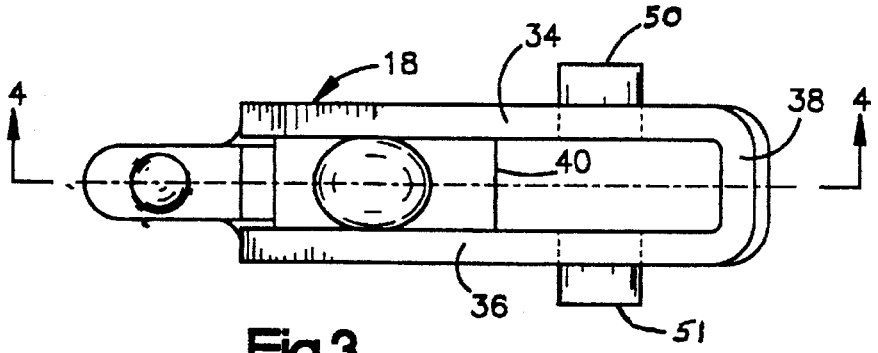
FIG. 3 is a plan view of a first rocker arm of the invention.
Figure 4:
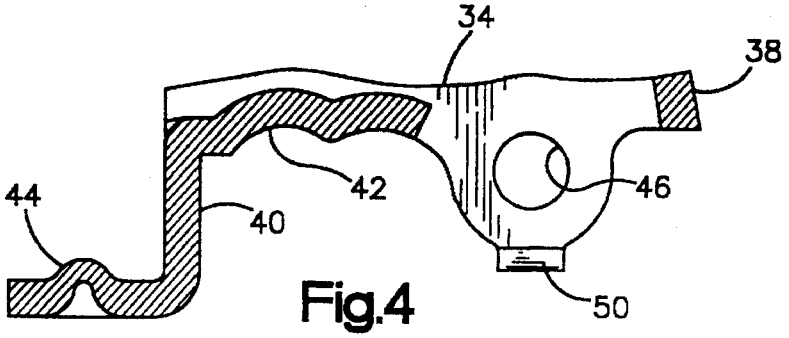
FIG. 4 is a section view taken along line 4—4 of FIG. 3.

Referring to FIGS. 3 and 4, the inner arm 18 is preferably a stamped structure which is generally U-shaped in plan, having spaced apart wall sections 34 and 36, a contact element 38 at the base of the U, and a central spine section 40. The spine section 40 defines the pivot point of the arm in the form of a socket portion 42 which contacts the outer arm as will be described below, and a spring retaining element 44. Aligned bores 46 are formed in the walls 34 and 36 to receive the axle of a needle roller assembly 48 (see FIG. 2). As will be described in more detail below, the contact element 38 defines a latch surface which interacts with the outer arm 22 and the latch member 28. A pair of outwardly extending stops 50, 51 are formed on the walls 34, 36 to limit relative movement between the inner and outer arms.

Figure 5:
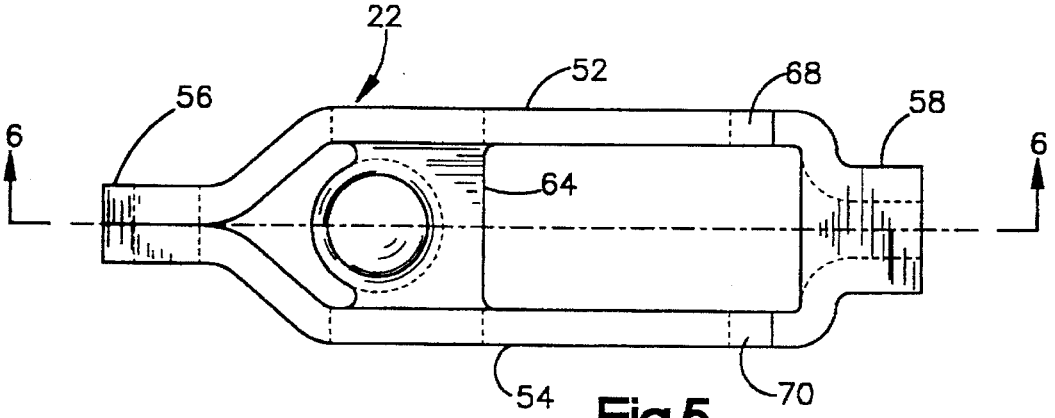
FIG. 5 is a plan view of a second rocker arm of the invention.
Figure 6:
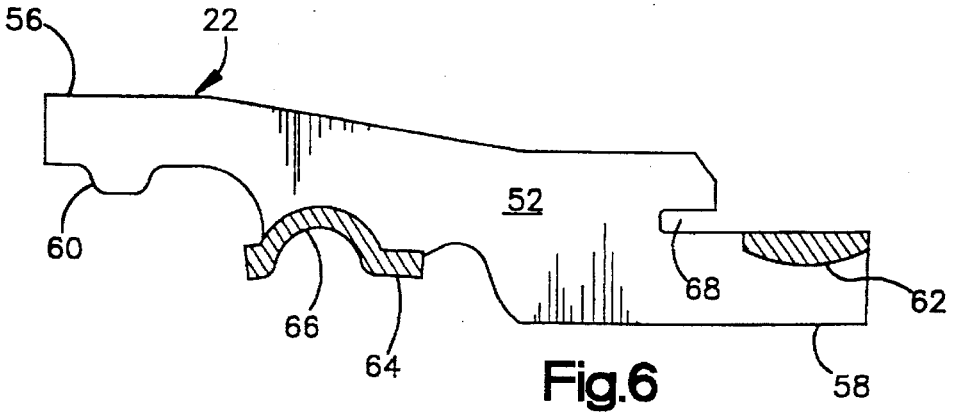
FIG. 6 is a section view taken along line 6—6 of FIG. 5.

Referring to FIGS. 5 and 6, the outer arm 22 is a generally rectangular member in plan view having spaced apart side walls 52 and 54 and converging end portions 56 and 58, the end portion 56 defining a spring-retaining element 60, and the end portion 58 defining a valve contacting pad 62. A web element 64 is formed between the walls 52 and 54 and defines a socket portion 66 which is received between the socket portion 42 of the inner arm and the lash adjuster plunger 30 when the arms are assembled. The walls 52 and 54 are slotted at 68 and 70 to receive the latch member 28.

Referring again to FIG. 2, at assembly the inner and outer arms are nested together with the spine section 40 of the inner arm 18 received over the web element 64 of the outer arm 22. The needle roller assembly 48 is received between the walls 34, 36 of the inner arm with the roller axle having a slip fit within the bores 46. With the inner arm being received between the walls 52, 54 of the outer arm, the axle 76 is always in contact with the walls during operation such that no positive retention means such as staking is required to retain the needle roller assembly.

When the assembled rocker arms are installed in the engine, the socket portion 66 of the outer arm 22 is positioned over the plunger 30 of the lash adjuster 32, which places the roller assembly 48 of the inner arm 18 in contact with the cam 20 and the contact pad 62 of the outer arm 22 in contact with the valve 24. When the spring 26 is positioned over the retainers 44 and 60 between the inner and outer arms, the inner arm 18 is biased into engagement with the cam 20 (via the roller 48) and the outer arm 22 is biased into engagement with the valve 24, the angular position of the rocker arm assembly 14 about the longitudinal axis of the lash adjuster being maintained by the end of the stem of valve 24 being trapped between the walls of the converging end portion 58 of the outer arm 22.

Figure 1:
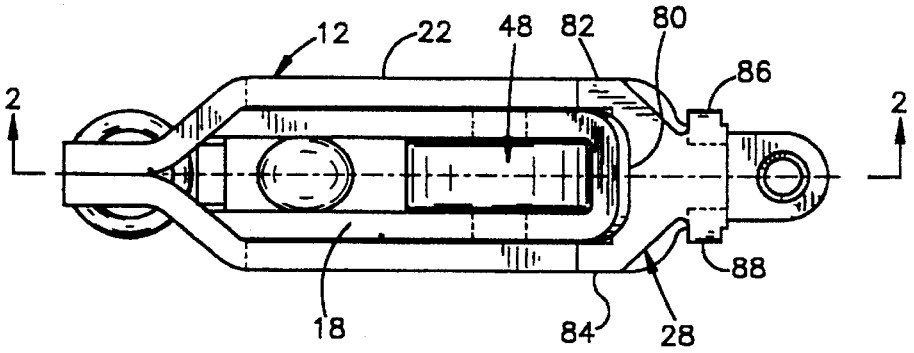
FIG. 1 is a partial plan view of the invention.

The control system 12 is shifted between its active and inactive modes by means of the latch member 28. In the embodiment shown, the latch is in the form of a plate which is mounted on the outer arm 22 and is engageable with the contact element 38 of the inner arm. The latch member 28 comprises a flat plate element 78 which slides along the top surface of the outer arm and which has a central region 80 which is engageable with the contact element 38 of the inner arm, and a pair of axially extending finger elements 82 and 84 which straddle the inner arm and are receivable within the slots 68 and 70 of the outer arm. The latch member is biased into its latched position and is maintained in position on the outer arm by means of tabs 86 and 88 which partly surround the end 58 of the outer arm. As illustrated in FIGS. 1 and 2 the latch member is shown in its active or engaged position with the central region 80 engaged by the inner arm. In this position, when the cam 20 rotates through the broken line position of FIG. 2, the force of the cam 20 on the roller 48 is transmitted to the outer arm 22 through the latch 28 and to the valve 24, moving the valve to its open position.

To shift the assembly form its active mode to its inactive mode, the latch member 28 is moved to the right as illustrated in FIG. 2 by means of actuator assembly 16 to slide the latch member out of engagement with the inner arm. With the latch disengaged, the force of the cam against the inner arm is not transmitted to the outer arm, and the valve remains in its closed position.

In the illustrated embodiment, the actuator assembly is shown somewhat schematically since a variety of linear actuating arrangements can be used to shift the latch member 28, and the actual arrangement employed will depend on space and mounting limitations associated with a particular engine in which the system is installed. As shown herein, the assembly comprises a bracket member 90 suitably attached to the engine, a solenoid 92 attached to the bracket, an actuating rod 94 which is pivotally mounted to the bracket at 96 and which is slidingly received within the latch member 28 and engaged by the output member 98 of the solenoid, and a compression spring 99 which acts between the solenoid 92 and the rod 94 to bias the latch member into a normally engaged position. To accommodate movement of the valve, the rod 96 is received through a spherical socket element 100 formed on the latch member 28, permitting the latch member to slide along the rod in moving between the valve closed position shown in the full line and the valve open position shown in broken line without undue lash between the actuator and the latch.

Figure 7:
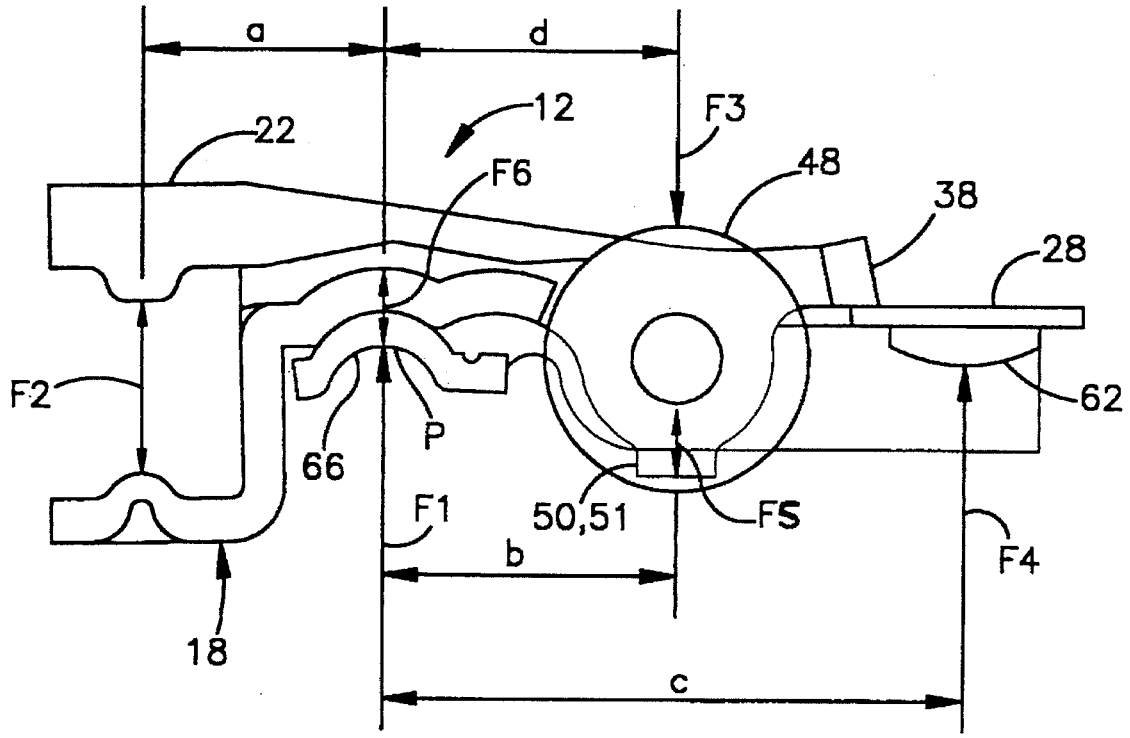
FIG. 7 is a schematic representation of the invention illustrating the forces acting thereon.

FIG. 7 is a schematic representation of the valve control system 12 which illustrates how the system overcomes the problems of lash adjuster pump up in the unlatched mode without requiring base circle contact elements and the like. Lash adjuster pump up is a major concern for maintaining proper function of the control system. Excessive pump up when the inner arm is engaged with the base circle of the cam 20 will affect both the latching and un-latching functions. In the latched mode pump up will cause the contact element 38 of the inner arm to be loaded against the latch member 28, not allowing the latch to disengage. In the unlatched mode, pump up will cause the element 28 to be below the latch, not allowing the latch to re-engage.

A pump up condition occurs when the upward force from the plunger 30 exceeds the downward load from the inner rocker arm at base circle. The force from the lash adjuster 32 is the sum of the plunger spring load and the force of the high pressure oil fed to the lash adjuster acting on the plunger projected area, which tries to push the plunger out of the body, the oil pressure being the major contributor. This non-equilibrium condition pushes the plunger and outer arm 22 upward, which causes the outer arm to pivot about the valve tip until a static equilibrium is reached. As the outer arm and plunger move axially upward, the inner arm 18 is also pushed upward. Since the cam 20 prevents the roller 48 from moving upward, the inner arm is forced to pivot about the axis of the roller as the plunger moves upward, compressing the spring 26 increasing the load between the inner and outer arms, resulting in either a static condition or until the plunger reaches its travel stop.

Converse to the pump up condition is leak down. This occurs when the load from the spring 26 exceeds that from the lash adjuster. Leak down is controlled by the stops 50 and 51, which engage the walls 52 and 54 of the outer arm. When the spring 26 applies a load to the stops, the load is shared between the lash adjuster and the stops until a static condition is achieved again. In the equations which follow, F1 is the force applied by the plunger 30 of the lash adjuster to the rocker arm assembly, F2 is the force of the spring 26 acting between the inner and outer rocker arms, F3 is the force of the cam 20 against the roller 48, F4 is the reaction force against the valve tip, F5 is the force between the inner and outer arms at the stops 50 and 51, and F6 is the force acting between the inner and outer arms at the plunger contact.

From the drawings it can be seen that the forces acting on the system act about the pivot point P defined by the socket element 66 of the outer arm. The spring force F2, acting about point P, applies a force against the inner arm 18 which maintains the roller 48 in contact with the cam 20 when the cam is on its base circle and which resists the cam force F3 as the cam rotates to its active or valve-open position. The force F2 also applies a force to the outer arm 22 which maintains the pad 62 in contact with the valve 24 in all operating modes.

When the system is in the engaged or active mode as illustrated in the drawings, force F3 applied by the cam 20 to the roller 48 is transmitted from the contact element 38 of the inner arm, through the latch member 28 to the outer arm 22, and to the valve 24, opening the valve against the force of the valve spring.

Shifting of the system from an active to an inactive mode is done when the roller 48 is in contact with the base circle portion of the cam and the forces acting on the latch mechanism are at a minimum. In the inactive mode the latch member 28 is removed from between the contact element 38 and the outer arm, allowing the inner and outer arms to pivot about each other at the lash adjuster, wherein the force F3 is insufficient to cause valve motion. In this condition, the spring force F2 is calculated to maintain the roller 48 of the inner arm in contact with the cam 20 and the outer arm in contact with the valve 24, while maintaining sufficient force against the plunger to counteract the plunger force F1 and prevent the lash adjuster from pumping up.

Referring to FIG. 7, the following equations define the above forces, wherein "$\epsilon$" is defined as the fraction of the spring force that is applied to the stops 50 and 51, which prevents the lash adjuster from leaking down when the cam is on base circle, and sets the lash at the latch member interface. (In theory this force could be zero):

$$\epsilon = \frac{F5}{F2} \tag{1}$$

$$F2 = \frac{(F1)(d)(c)}{(c-d)(a-\epsilon b)} \tag{2}$$

$$F4 = \frac{(F1)(d)}{(c-d)} \tag{3}$$

$$F3 = \frac{(F1)(c)}{(c-d)} \tag{4}$$

$$F6 = (F1)(c)\left(\frac{(d+a)+\epsilon(d-b)}{(c-d)(a-\epsilon b)}\right) \tag{5}$$

We claim:

1. A valve control system for an internal combustion engine including a cylinder head, a poppet valve, and a camshaft having a cam lobe formed thereon; said control system comprising means on said cylinder head defining a pivot point; a first rocker arm mounted for rotation about said pivot point and engageable with said poppet valve; a second rocker arm mounted for rotation relative to said first rocker arm and engageable with said cam lobe; means biasing said first rocker arm into engagement with said pivot point and said second rocker arm into engagement with said cam lobe; and means for selectively interconnecting said first and second rocker arms for movement in unison about said pivot point in response to a force applied by said cam lobe to said second rocker arm; said means biasing said first rocker arm into engagement with said pivot point and said second rocker arm into engagement with said cam lobe comprises a spring acting between said first and said second rocker arms; characterized by:

(a) said first rocker arm comprises a first elongated arm member having a valve contacting element formed at one end thereof, a first spring receiving surface formed at the opposite end thereof, and a first pivot bearing element formed between said valve contacting element and said spring receiving surface, and said second rocker arm comprises a second elongated arm member having a contact surface formed at one end thereof, a second spring receiving surface formed at the opposite end thereof, and a second pivot bearing element formed between said contact surface and said spring receiving surface.

2. Apparatus as claimed in claim 1, in which said means for interconnecting said first and second rocker arms comprises a member slidably mounted on one of said first and second rocker arms and movable between a first position wherein it is engageable by the other of said rocker arms and a second position wherein it is not engageable by said other rocker arm, and means operable to move said member between said first and second position.

3. Apparatus as claimed in claim 1 in which said pivot bearing element defining a first concave bearing surface and a convex bearing surface; and having a second concave bearing surface formed thereon, and a cam contacting element between said pivot bearing element and said contact surface; said first arm member being received on said means defining a pivot point with the first concave bearing surface in contact with said pivot point, and said second arm member being received on said first arm member with the second concave bearing surface being in engagement with said convex bearing surface; said spring acting between said first and second rocker arms comprising a compression spring received between said first and second spring receiving surfaces.

4. Apparatus as claimed in claim 3 which said cam contacting element comprises a roller mounted for rotation on said second arm member.

5. Apparatus as claimed in claim 3 in which said first arm member comprises a generally rectangular structure having spaced apart side walls and converging end walls, one of said end walls defining said first spring receiving surface; and a web element formed between said spaced apart walls, said first pivot bearing element being formed on said web element; and said second arm comprises a generally rectangular structure including a generally U-shaped potion having spaced apart walls and a closed end portion defining said contact surface, and a spine element formed between said walls, a first portion of said spine element defining said second pivot bearing element and a second portion of said spine element defining said second spring receiving surface; said first and second arms interfitting with said second arm being received within the spaced apart walls of the first arm spring retaining surfaces and said spring being arranged such that the biasing force of said spring is effective to maintain the second pivot bearing surface in engagement with said first pivot bearing surface.

6. Apparatus as claimed in claim 4 in which said roller is mounted on an axle received in through bores formed in the spaced apart wall portions of said second arm, the axle being retained by contact with the spaced apart walls of said first arm.

7. Apparatus as claimed in claim 5, including one or more stops formed on said second arm and engageable with said first arm to limit relative movement between said first and second arms.

8. Apparatus as claimed in claim 5 in which the contact surface on said second arm is arranged in close proximity to a first converging end wall of said first arm, said first end wall having a flat surface formed thereon, and said means for selectively interconnecting comprises a plate member which is slidable along said flat surface into a position wherein it is contacted by said contact surface when said arms are pivoted relative to one another.

9. Apparatus as claimed in any one of claims 1 through 8 in which said pivot point is defined by the output member of a hydraulic lash adjuster mounted on said cylinder head.

* * * * *